United States Patent [19]

Hilding

[11] 3,977,480

[45] Aug. 31, 1976

[54] ARRANGEMENT FOR EXCHANGING DRILL BITS

[75] Inventor: Jonas Olof Anders Hilding, Nacka, Sweden

[73] Assignee: Atlas Copco Aktiebolag, Nacka, Sweden

[22] Filed: Dec. 16, 1974

[21] Appl. No.: 533,136

[30] Foreign Application Priority Data

Dec. 21, 1973 Sweden ..... 7317339

[52] U.S. Cl. ..... 175/85; 175/122; 175/135; 175/203

[51] Int. Cl.[2] ..... E21B 19/14; E21B 3/02

[58] Field of Search ..... 175/85, 52, 122, 135, 175/162, 203; 214/2.5

[56] References Cited

UNITED STATES PATENTS

| | | | |
|---|---|---|---|
| 2,781,185 | 2/1957 | Robbins | 175/85 X |
| 3,194,313 | 7/1965 | Fanshawe | 175/85 X |
| 3,336,991 | 8/1967 | Klein et al. | 175/85 |
| 3,734,208 | 5/1973 | Otto | 175/52 |
| 3,833,072 | 9/1974 | Back | 175/85 |

*Primary Examiner*—James A. Leppink
*Attorney, Agent, or Firm*—Flynn & Frishauf

[57] ABSTRACT

In a drill rig, a device for exchanging a drill bit is mounted on a feed bar and is arranged movably to and from the drill axis. The bit exchanging device comprises means for holding a bit being brought thereinto non-rotatively during rotation of the drill string. Furthermore, there are means for providing an anvil to the bit when delivering impacts against the drill string.

13 Claims, 7 Drawing Figures

14
15
24
26
25
27
12
26
23
22
13
290
20
11
10
16
21
17
18
19

201
271
267
269
270
268
262
225
264
260
259
261
263
21
268
271
266
267
VII
256
263
VII
265
257
254
258
L2
255
252
251
14
201
20
14
253
21

ARRANGEMENT FOR EXCHANGING DRILL BITS

This invention relates to an arrangement in drill rigs wherein a rock drilling machine is movable reciprocably along a feed bar and a device for exchanging a drill bit mounted on a drill string is arranged movably to and from the drill axis at the forward end of the feed bar.

Devices for exchanging drill bits are previously known. In one known construction, by way of example, a magazine for several drill bits is mounted at the forward end of a feed bar. In this construction, a holder-on intended to intermesh the bit for locking the latter against rotation has been mounted on the outer end of a swingable arm.

When a drill bit has to be unscrewed from a drill rod, it occurs that the threaded connection has stuck so firmly that it cannot be loosened only by providing a relative rotation between the rod and the bit.

It is an object of the invention to design the bit-receiving device in such a way that, when so being necessary for loosing the threaded connection, it is possible to deliver impacts against the rod by means of the impactor of the rock drilling machine after having brought the bit into the bit-receiving device.

SUMMARY OF THE INVENTION

According to one aspect of the invention there is provided in a drill rig, in combination: an elongated support, a rock drilling machine mounted on said support for reciprocal movement therealong a plurality of drill rods for making up a drill string, said drill string being connectable at one end thereof to said rock drilling machine to be rotated and driven longitudinally with respect to said support, a drill bit mounted on the other end of said drill string, a device at the forward end of said support for exchanging said drill bit, and the improvement comprising: means in said bit exchanging device for receiving said drill bit, means for moving said device to and from the axis of said drill string, means in said bit receiving means for holding the bit non-rotatively during rotation of said drill string, and means for providing an anvil to the bit when delivering impacts against said drill string by said rock drilling machine.

According to another aspect of the invention there is provided in a drill rig, in combination: an elongated support, a rock drilling machine mounted on said support for reciprocal movement therealong, a plurality of drill rods for making up a drill string, said drill string being connectable at one end thereof to said rock drilling machine to be rotated and driven longitudinally with respect to said support, a drill bit mounted on the other end of said drill string, a device at the forward end of said support for exchanging said drill bit, and the improvement comprising: means for moving said device to and from the axis of said drill string, an outer casing in said device, a receptacle in said casing for receiving a drill bit, said receptacle being limitedly movable forward in said casing against spring action by said drill string when a drill bit is brought into said receptacle, a drill rod centralizer, a saddle for carrying said drill rod centralizer movably along said support, means on said support for locking said saddle against a movement forward when said saddle is in a position where moved rearwardly of said device, abutting means on said drill rod centralizer at the forward end thereof, abutting means on said receptacle at the rear end thereof, said abutting means on the drill rod centralizer and the receptacle respectively being arranged to rest against each other when said receptacle is moved forward by said drill string so that stresses produced in said device when impacts are delivered against said drill string by said rock drilling machine are transferred via said abutting means to said locking means.

The above and other purposes of the invention will become obvious from the following description and from the accompanying drawings in which one embodiment of the invention is shown by way of example. It is to be understood that these embodiments are only illustrative of the invention and that various modifications thereof may be made within the scope of the claims following hereinafter.

DETAILED DESCRIPTION OF ILLUSTRATED EMBODIMENT

Figure 1:
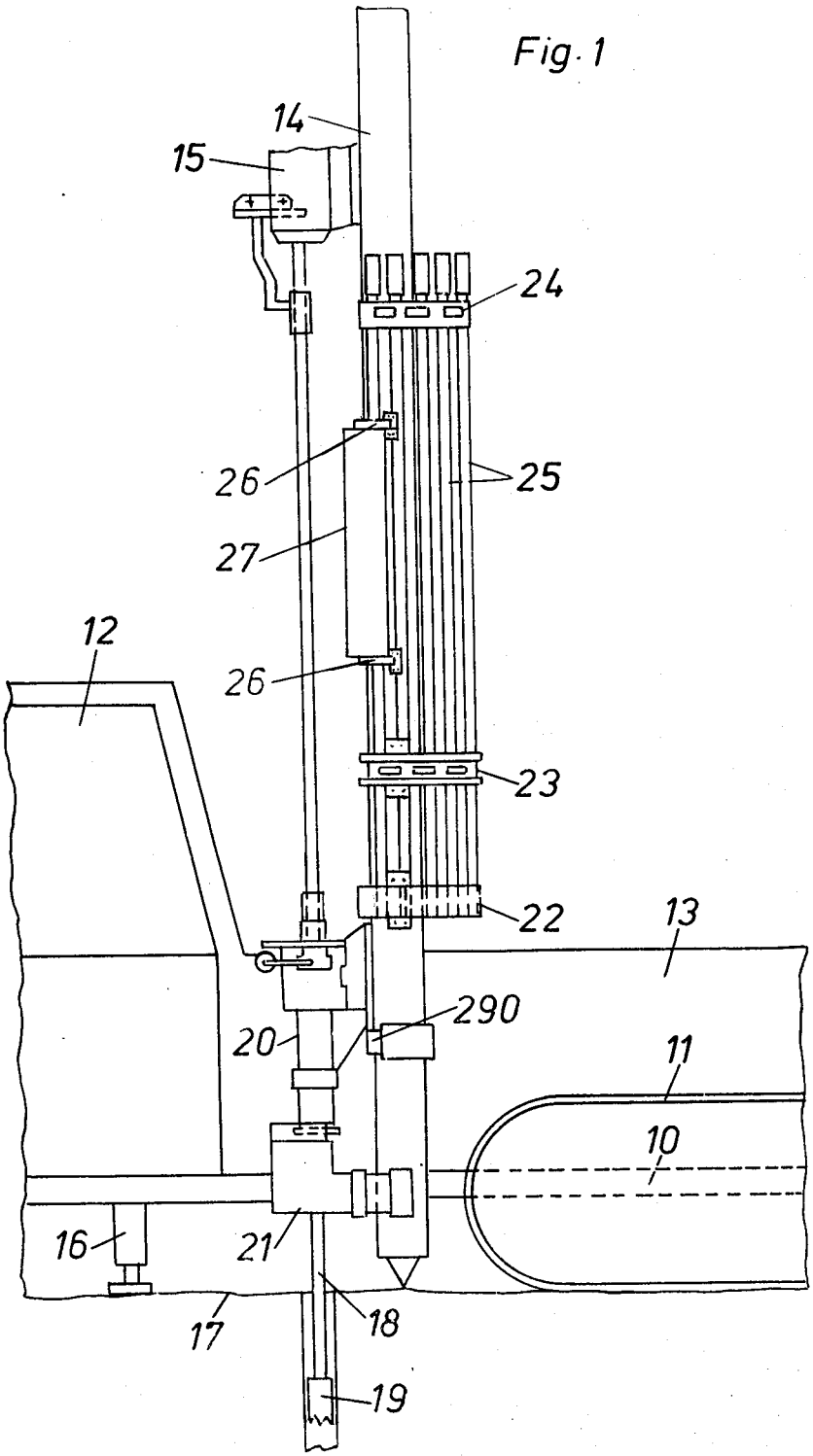
FIG. 1 shows diagrammatically a side view of a crawler mounted drill rig with an arrangement for exchanging bits according to the invention.

FIG. 1, a drill rig is diagrammatically shown, having a chassis 10, crawlers 11, an operator's cab 12, a machinery housing 13 accomodating a Diesel engine, hydraulic pumps and a compressor unit, and a feed bar 14. A rock drilling machine 15, preferably hydraulic, is in known manner movable along the feed bar 14. During drilling, the chassis 10 is raised from the ground 17 by means of hydraulic levelling jacks 16. A magazine for drill rods 25 comprising three axially spaced members 22, 23 and 24 is mounted beside the feed bar 14. The drill rods are moved one by one between the magazine and the drill axis by means of a swingable transferring arm 26 with a spinning device 27 for gripping and rotating the rods turnably journalled in the outer end. At the front end of the feed bar 14, there is a drill rod centralizer 20 for a string 18 of connected extension rods. The drill rod centralizer 20 is mounted on a saddle which is freely slidable along the feed bar. In FIG. 1, the drill rod centralizer is shown in a rear position, where it can be locked by means of hydraulically operated lugs 290. On either side of the feed bar there is a drill bit exchanging device 21 swingably journalled in such a way that it can be swung to the drill axis, when the drill rod centralizer 20 is in the shown position and the drill bit 19 is drawn up thereinto. A detailed description of the magazine and the transferring arm 26 with the spinning device 27 is not necessary to understand the present invention and is therefore omitted. Such a detailed description of the members mentioned above is to be found in Swedish Patent No. 7317338-7, corresponding to U.S. patent application Ser. No. 533,134, filed Dec. 16, 1974.

Figures 6, 7:
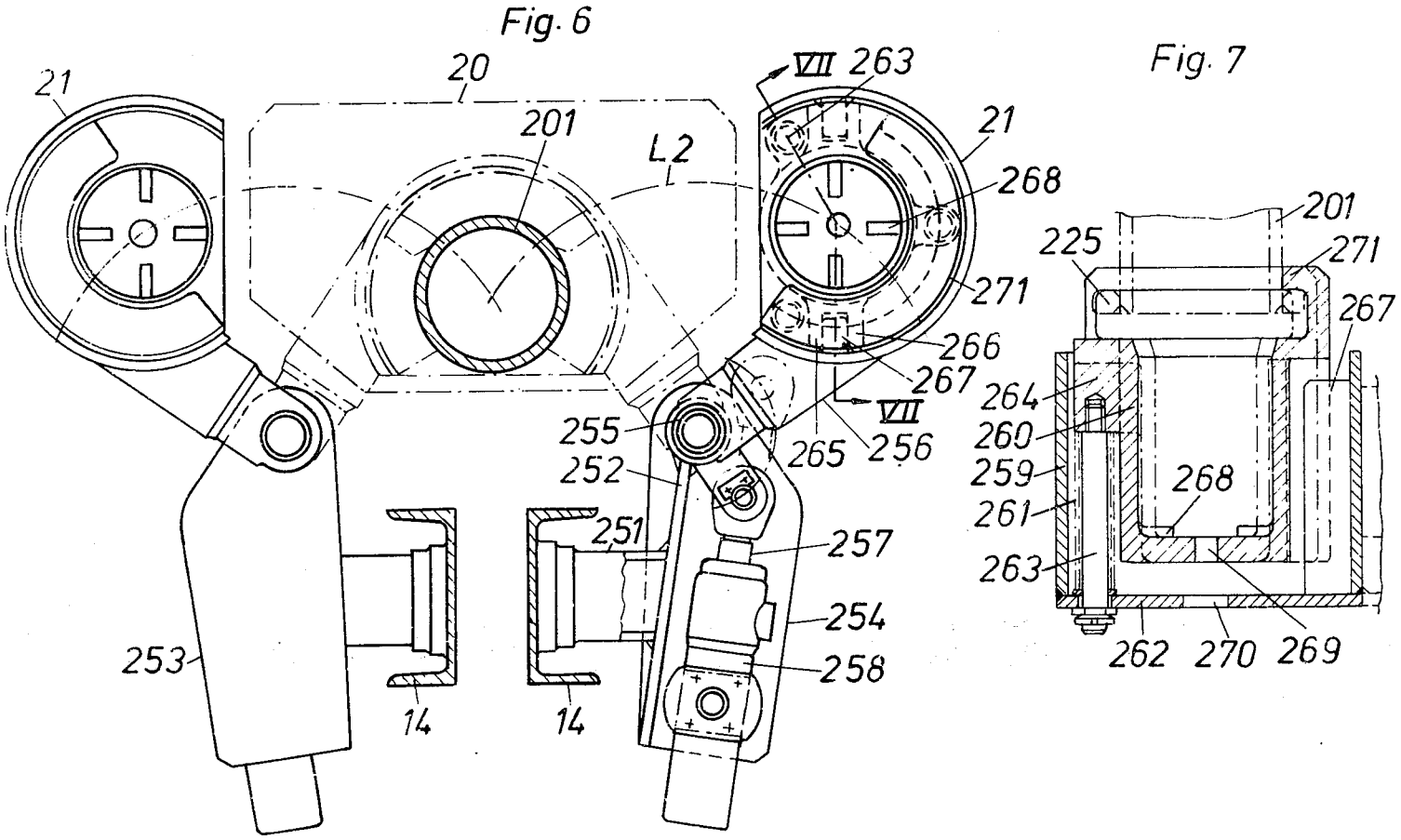
FIG. 6 shows a top view of drill bit exchanging devices arranged at either side of the feed bar.
FIG. 7 is a longitudinal section through a bit exchanging device, taken on the line VII—VII in FIG. 6.

In FIG. 6, a top view is shown of the drill bit exchanging devices 21 arranged symmetrically at either side of the feed bar 14. An arm 251 is attached to the feed bar 14. The other end of said arm is connected to a plate 252. The plate 252 extends between two plates, an upper plate 253 and a lower plate 254, located in planes normal to the longitudinal direction of the feed bar. A bearing bushing 255 for a curved arm 256 is attached to one end face of the plate 252. The one end of the arm 256 carries a drill bit exchanging device 21 and the other end is pivotally connected to a piston rod 257 of a hydraulic cylinder 258. If the piston rod 257 is projected, the center of the bit changing device 21 will move along the circle arc $L_2$ to the drill axis.

As may be seen in FIG. 7, the drill bit exchanging device 21 comprises an outer casing 259 and a basket or receptacle 260 mounted therein. Three springs 261 arranged symmetrically around the basket extend between the bottom 262 of the casing and a thickened portion 264 of the basket. The spring 261 is pushed on a rod 263 being screwed into the thickened part 264. On the outside of the basket 260 there are flanges 265 and 266. A guiding rule 267 attached to the inside of the casing 259 extends between these flanges. The guiding rule 267 and the flanges 265 and 266 prevent the basket 260 from being turned relative to the casing 259. In the bottom of the basket 260 there are shoulders 268 intended for co-operation with a drill bit brought into the basket to prevent the drill bit from being turned relative to the basket. In the bottom of the basket and the casing respectively there are draining holes respectively 269 and 270. At the upper portion of the basket 260 there is a flange 271 which extends along about half the circumference of the basket.

Figure 3:
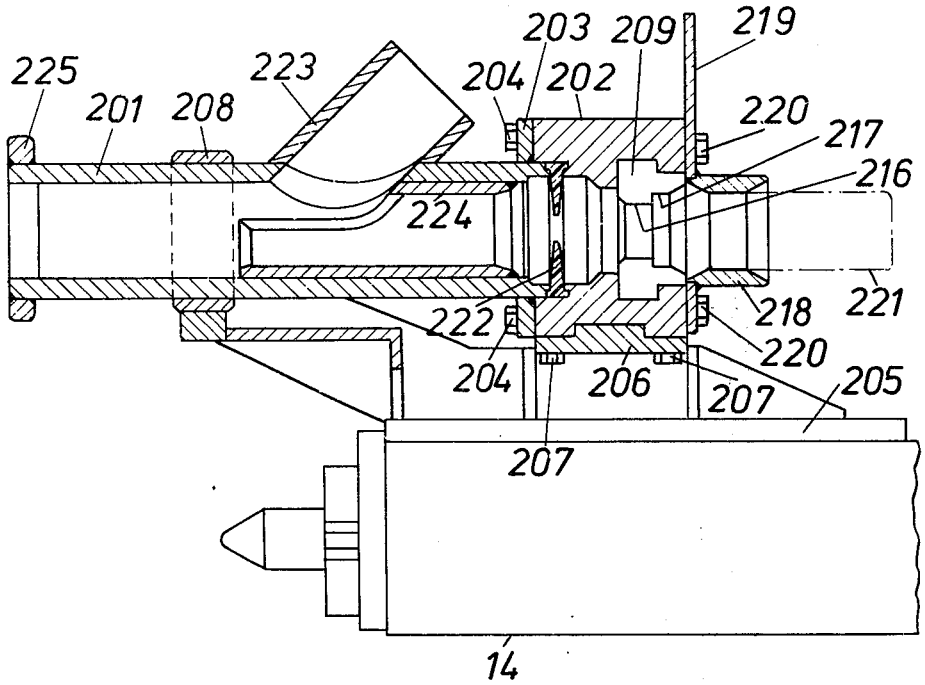
FIG. 3 shows in longitudinal section the drill rod centralizer, taken on the line III—III in FIG. 2.
Figure 2:
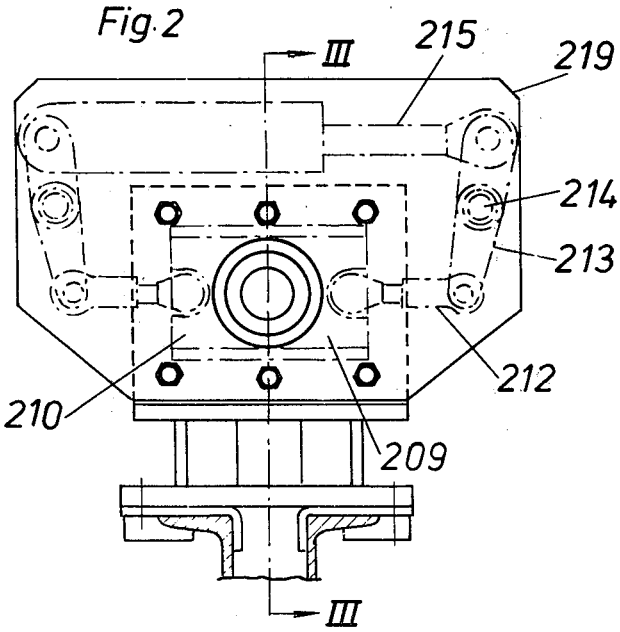
FIG. 2 shows a top view of a drill rod centralizer mounted on the feed bar of the drill rig.

As evident from the longitudinal section through the drill rod centralizer 20 shown in FIG. 3, the latter comprises substantially two members, a tubular member 201 and a prism shaped member 202. A flange 203 is welded to the upper portion of the tube 201. The flange 203 is connected to the member 202 by means of screws 204. The drill rod centralizer is mounted on a saddle 205, which is slidable along the feed bar 14. A plate 206 is welded to the upper portion of the saddle. The member 202 is attached to the plate 206 by means of screws 207. The tubular member 201 is attached to the lower portion of the saddle 205 by means of a clamp 208. A flange 225 is attached to the lowermost portion of the tube 201. Two cooperating, hydraulically controlled jaws 209 and 210 are slidably mounted in the prism shaped member 202. The jaw 209 is movable (FIG. 2) by means of an arm 212, a second arm 213 pivotally connected to said arm, which second arm is swingable about a shaft 214 and by means of a piston rod 215 of a cylinder, which piston rod is pivotally connected to the opposite end of the arm 213. In a position where brought together, the jaws 209 and 210 provide between themselves a first cylindrical portion 216, the diameter of which is a little larger than that of the drill rod. A second cylindrical portion 217 has a diameter which is a little smaller than the outer diameter of a coupling sleeve 221, which connects two drill rods to each other. A plate 219 is fastened to the upper side of the member 202 by means of screws 220. A cylindrical sleeve 218 is welded to the plate 219. The sleeve 218 has substantially the same inner diameter as the outer diameter of the coupling sleeve 221. A seal ring 222, preferably of a plastic material, is inserted at the upper portion of the tube 201 between said portion and the member 202. A second tube 223 is welded to the envelope surface of the tube 201 at about the middle thereof. Inside the tube 201 between the upper portion thereof and the tube 223, there is a sleeve 224 firmly attached to the tube 201. The inner diameter of the sleeve 224 accords substantially with the outer diameter of the coupling sleeve 221. The tube 201 is intended to guide the drill bit at the collaring of a new hole, for which reason the inner diameter of the tube substantially accords with the outer diameter of the drill bit.

Figure 5:
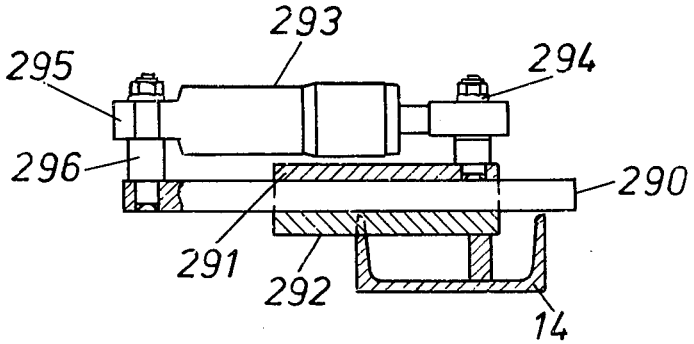
FIG. 5 is a section through the stop lug, taken on the line V — V in FIG. 4.
Figure 4:
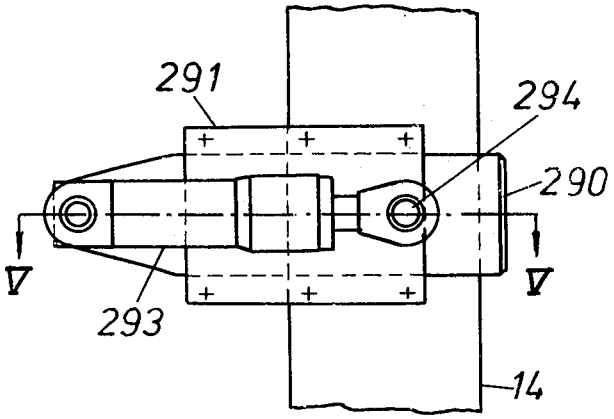
FIG. 4 shows a side view of a stop lug for the drill rod centralizer mounted on the feed bar.

On either side of the feed bar 14 (FIG. 4), there is a stop lug 290 for the saddle 205 of the drill rod centralizer. The stop lug 290 is guided between two parallel plates 291, 292 fastened with screws to each other. The plate 292 is attached to the feed bar 14. The piston rod of a cylinder 293 is pivotally connected to the plate 291 by means of a shaft 294. The rear portion 295 of the cylinder is pivotally connected to the stop lug 290 by means of a shaft 296. In the projecting position shown in FIGS. 5 and 6, the stop lug is intended to co-operate with a lower portion of the saddle 205 of the drill rod centralizer, thereby locking the saddle against a displacing movement forwards.

The arrangement according to the invention operates as follows. The rock drilling machine 15 is moved along the feed bar 14 to a position behind the drill rods 25 in the magazine. The transferring arm 26 is swung towards the magazine where the spinning device 27 grips a rod. The spinning device comprises three mutually opposed rollers resting against the rod, one of which being reversibly driven. The two others are movable towards and away from one another. The axes of the rollers are inclined with respect to the drill axis, by which the rod, when being rotated by means of the driven roller, at the same time is moved axially. The transferring arm 26 transfers the rod to the drill axis. A drill bit exchanging device, 21, with a drill bit placed therein, is swung to the drill axis. By rotating the inclined rollers, the rod 25 is screwed into the drill bit nonrotatably held by the bit exchanging device. During these operations, the drill rod centralizer 20 is in a position above the bit exchanging devices and is locked in this position by means of the hydraulically operated lugs 290, which are movable in a direction perpendicular to the longitudinal direction of the feed bar 14 and which are intended for co-operation with the saddle 205. When the drill bit has been screwed on, the rock drilling machine 15 is fed towards the rod 25 and its adapter is screwed into a coupling sleeve being screwed on the rear end of the rod. The tongs of the spinning device 27 are opened and the transferring arm 26 is swung towards the magazine and stays there while gripping the rod coming next by the spinning device.

The rod 25 is drawn up by means of the rock drilling machine until the drill bit reaches the bit guide of the tube 201. The bit exchanging device 21 is now swung away from the drill axis. The jaws 209 and 210 in the drill rod centralizer 20 are brought together and the lugs 290 are moved out of engagement with the saddle 205. The drill rod centralizer is now carried by the drill bit. The rock drilling machine is fed ahead until the drill rod centralizer with its flange 225 rests against the ground. By the fact that the whole drill rod centralizer with the bit guiding tube slides down to abutment against the ground, there is achieved an effective guiding of the bit during the collaring, by means of which the hole really is formed in the direction to which the feed bar has been adjusted. This fact makes possible that the collaring can be carried out with full efficiency independently of the nature of the ground. At a collaring where the rock surface is covered by a loose overburden, a crater arises easily around the hole. In this case, the bit guiding tube follows to the bottom of the crater and there guides the drill bit. If a great accuracy regarding direction and straightness of the hole is required, the drill bit can be designed with an extended guiding length. The tube 223 of the drill rod centralizer is connected to a drill dust suction system (not shown). By the good ground contact and by the good accordance with the hole diameter of the drill bit guiding tube there is also achieved an effective removal of drill dust. During drilling, the jaws 209 and 20 will on the one hand guide the drill rod and on the other seal against a rearward blowing-out of the drill dust. The ring 222 contributes to a still improved sealing for the blowing-out of drill dust.

When the drill rod has been drilled down so far that the coupling sleeve 221 screwed on the rear end thereof has reached the sleeve 218, the drilling is broken off. The rock drilling machine is rotated in a reverse direction, whereas the adapter is screwed out of the coupling sleeve. A sleeve brake (not shown) placed on the slide of the rock drilling machine is swung automatically towards and against the sleeve 221 at a reversed rotation of the rock drilling machine. At the unscrewing of the adapter, the sleeve, then, will remain on the end of the drill rod. After the unscrewing of the adapter, the rock drilling machine is moved backwards along the feed bar to a position above the magazine member 24. After that, the transferring arm 26 takes a new drill rod to the drill axis. When in alignment with the drill axis, the drill rod is screwed into the coupling sleeve on the rod next ahead by rotating the motors of the spinning device 27. The string being in the drill hole is guided during the coupling by the jaws 209, 210. The adapter of the rock drilling machine is screwed into the coupling sleeve of the new drill rod and the transferring arm 26 is swung to the magazine where the spinning device 27 grips the rod coming next. The time during which the sleeve passes the jaws 209, 210 while being moved downwards, the jaws have to be opened. Sealing and guiding are then instead secured against the outer diameter of the sleeve by the fact that the fixed passages 224 and 218 respectively which are mounted respectively below and above the jaws have an inner diameter which is about equal with the outer diameter of the sleeve. The drilling continues until the desired hole depth is reached or until the drill bit because of wear has to be exchanged to a new one.

Before the drill string is drawn up out of the hole, the threads incorporated in the string are shaken to come loose by the impactor of the rock drilling machine while the bit rests against the bottom of the hole. The drill rod centralizer 20 is drawn up along the feed bar by the resting of the coupling sleeve 221 against the underside of the jaws 209, 210 during the withdrawal of the string. The drill rod centralizer is kept in a drawn-up position by means of the hydraulically operated lugs 290. During the withdrawal, the jaws 209, 210 have for a purpose to grasp around and under the coupling sleeves 221 in order to hold the string in the hole. The transferring arm 26 is swung to the drill axis, where the spinning device 27 grips the rod, after which the adapter of the rock drilling machine is screwed out of the coupling sleeve of the uppermost drill rod, whereas the sleeve brake safeguards that the sleeve remains on the rod. The rod is after that screwed out of the sleeve being in the drill rod centralizer 20 by means of the spinning device 27 and is transferred to the magazine. The axially affixed position of the drill rod centralizer has been suited with respect to the bottom of the magazine so that the rod being unscrewed is at the right height. The rock drilling machine, then, is moved down and draws up the string another rod length, after which the next rod is unscrewed and is transferred to the magazine. The withdrawal of drill rods continues in the same way until only the last rod is left This rod is drawn up by the rock drilling machine until the drill bit reaches the bit guiding tube 201. If the drill bit has to be exchanged, an empty bit exchanging device 21 is swung to the drill axis. The drill bit is brought down into the basket 260 of the bit exchanging device. The basket moves toward the bottom of the casing 259 while compressing the springs 261. The movement of the basket 260 continues until its flange 271 is brought to rest against the annular flange 225 of the drill rod centralizer. In certain cases, the drill bit is stuck so firmly that its thread has to be blown to come loose by means of the impactor of the rock drilling machine. In doing so, the basket 260 will form an anvil for the drill bit. The stresses on the bit exchanging device generated by the blows is transmitted to the drill rod centralizer via the flange 271 and is taken up by the lugs 290. Therefore, there is no risk of breaking the suspension of the casing 259. The adapter of the rock drilling machine is screwed out of the coupling sleeve, after which the spinning device 27 unscrews the drill rod from the drill bit. The bit exchanging device with the worn bit is swung aside and the other bit exchanging device with a sharpened bit is swung to the drill axis. The sharpened bit is screwed on the rod after which the string is assembled and a continued drilling is carried out.

If a joint in the string has not gotten loose, this one has to be broken manually. This system is economically the most advantageous provided that it is not frequently that manual breaking has to be resorted to. If necessary, however, the saddle of the drill rod centralizer can be completed on the one hand with a couple of non-rotating jaws with a greater clamping capacity than the shown ones and gripping about the round drill rod below the coupling sleeve and on the other with a swingable and turnable pipe wrench, which grips about the round rod above the sleeve.

The invention is not limited to the embodiment shown in the drawings as an example, but can be modified within the scope of the claims following hereinafter without departing from the inventive concept. Thus, in an arrangement which does not have the above described drill rod centralizer, a suspension device of arbitrary type for the bit basket can be mounted on the feed bar.

What I claim is:

1. In a drill rig in combination: an elongated support (14), a rock drilling machine (15) mounted on said support for reciprocal movement therealong, a plurality of drill rods for making up a drill string (18), said drill string being connectable at one end thereof to said rock drilling machine to be rotated and driven longitudinally with respect to said support, a drill bit (19) mounted on the other end of said drill string, at least one drill bit exchanging device (21) at the forward end of said support for exchanging said drill bit, the improvement comprising:

means (260) in said at least one bit exchanging device for receiving said drill bit, means for moving said at least one bit exchanging device to and from the axis of said drill string, holding means (268) in said bit receiving means for holding the bit non-rotatively during rotation of said drill string, and means including said receiving means for providing an anvil for the bit when delivering axially directed impacts against said drill string by said rock drilling machine and for transferring said axially directed impacts from said receiving means to said elongated support to loosen the bit from said drill string.

2. Apparatus according to claim 1, comprising a first and a second drill bit exchanging device (21), said drill bit exchanging devices being mounted swingably on said support at either side thereof.

3. Apparatus according to claim 1, comprising means (20) mounted on said support and arranged to cooperate with said at least one bit exchanging device when the latter is in a position where moved to the drill axis, for taking up the stresses on said at least one bit exchanging device caused by impacts against a bit being brought into said bit receiving means.

4. Apparatus according to claim 3, wherein:

said bit receiving means (260) comprises a receptacle (260).

said at least one bit exchanging device comprises an outer casing (259), said receptacle (260) being in said outer casing, and spring means (261) in said outer casing between the bottom thereof and said receptacle, said receptacle being limitedly movable substantially in the direction of the axis of said drill string against the action of said spring means, and said holding means (268) is in said receptacle (260) and includes means for securing a drill bit against rotation relative to said receptacle (260) when moved thereinto.

5. Apparatus according to claim 4, wherein said at least one bit exchanging device further comprises:

a guiding rule (267) on said outer casing (259) extending radially inwards, flanges (265, 266) on said receptacle (260) disposed on opposite sides of said guiding rule for preventing said receptacle from being turned relative to said outer casing, a thickened portion (264) on said receptacle, and a surface facing forwardly on said portion, said spring means (261) being disposed between the bottom of said outer casing and said forwardly facing surface.

6. Apparatus according to claim 4, comprising a carrying member (20) secured to said support, and wherein said receptacle (260) is movable forwardly to a position where resting against said carrying member (20), said carrying member being adapted to transfer stresses caused by impacts against the drill string from said receptacle to said support.

7. In a drill rig, in combination:

an elongated support (14), a rock drilling machine (15) mounted on said support for reciprocal movement therealong, a plurality of drill rods for making up a drill string (18), said drill string being connectable at one end thereof to said rock drilling machine to be rotated and driven longitudinally with respect to said support, a drill bit (19) mounted on the other end of said drill string, at least one drill bit exchanging device (21) at the forward end of said support for exchanging said drill bit, the improvement comprising:

means for moving said at least one drill bit exchanging device (21) to and from the axis of said drill string, an outer casing (259) in said at least one drill bit exchanging device, a receptacle (260) in said outer casing for receiving a drill bit, said receptacle being limitedly movable in the forward direction in said outer casing against spring action by said drill string when a drill bit is brought into said receptacle, a drill rod centralizer (20), a saddle (205) for carrying said drill rod centralizer movably along said support, locking means (290) on said support for locking said saddle against a forward movement when said saddle is in a position where moved rearwardly of said at least one drill bit exchanging device, first abutting means (225) on said drill rod centralizer at the forward end thereof, and second abutting means (271) on said receptacle at the rear end thereof, said first and second abutting means being respectively arranged to rest against each other when said receptacle is moved forward by said drill string so that stresses produced in said at least one drill bit exchanging device (21) when impacts are delivered against said drill string by said rock drilling machine are transferred via said first and second abutting means to said locking means (290).

8. Apparatus according to claim 7, wherein said first abutting means comprises a first annular flange (225) on the drill rod centralizer, and said second abutting means comprises a second flange (271) attached to said receptacle, said second flange covering said first annular flange along about half the circumference thereof when resting thereagainst.

9. Apparatus according to claim 7, comprising a first and a second drill bit exchanging device (21), said drill bit exchanging devices being swingably mounted on said support at either side thereof.

10. Rock drilling equipment including a device for mechanized exchange of drill bits that have been screwed by means of threads onto drill rods (25), comprising:

an elongated support (14), a rock drilling machine for moving said drill rods in the longitudinal direction in a path of movement along said support and for rotating said drill rods, the forward end of said drill rods having means for carrying a drill bit (19), at least one drill bit engaging member (21) carried by said support at the forward end thereof, and means for moving said at least one drill bit engaging member mechanically to a position of engagement located in the path of movement of the drill rods and mechanically from said engagement position to a non-operative position to the side of said path of movement, said at least one drill bit engaging member including drill bit catching means (260) for non-rotationally engaging the drill bit for screwing on or off the drill bit by relative motion between the drill rod and drill bit catching means when in said engagement position, and further including means for providing an anvil for the drill bit when axially directed impacts are delivered against said drill rods by said rock drilling machine and for transferring said axially directed impacts from said drill bit engaging member to said elongated support to loosen the drill bit from a drill rod, and said at least one drill bit engaging member permitting the passage of the drill rods for drilling when being in said non-operative position.

11. Apparatus according to claim 10, wherein said at least one drill bit engaging member comprises an outer casing (259), and spring means (261) in said outer casing operatively connected between said outer casing and the drill bit catching means, said drill bit catching means being limitedly movable in the forward direction substantially in the direction of the path of movement of the drill rods against the action of said spring means.

12. Apparatus according to claim 11, comprising a stop means (20, 290) secured to the support (14), said stop means being adapted to abut said drill bit catching means after a forward movement thereof, thereby transferring stresses caused by impacts against a non-rotationally engaged drill bit from the at least one drill bit engaging member to said support.

13. Apparatus according to claim 10, comprising a first and a second drill bit exchanging member (21), said drill bit exchanging members being swingably mounted on said support at either side thereof.

* * * * *